US007281564B2

(12) United States Patent
Dekker

(10) Patent No.: US 7,281,564 B2
(45) Date of Patent: Oct. 16, 2007

(54) TASSEL FOR A COVERING FOR AN ARCHITECTURAL OPENING

(75) Inventor: Nicolaas Dekker, Barendrecht (NL)

(73) Assignee: Hunter Douglas Industries BV, El Rotterdam (NL)

( * ) Notice: Subject to any disclaimer, the term of this patent is extended or adjusted under 35 U.S.C. 154(b) by 458 days.

(21) Appl. No.: 10/921,597

(22) Filed: Aug. 18, 2004

(65) Prior Publication Data

US 2005/0045282 A1 Mar. 3, 2005

(30) Foreign Application Priority Data

Sep. 1, 2003 (EP) ..... 03077740

(51) Int. Cl.
*E06B 9/00* (2006.01)

(52) U.S. Cl. ..... 160/178.1 R; 160/173 R; 160/177 R

(58) Field of Classification Search ..... 160/178.1 R, 160/173 R, 168.1 R, 177 R, 176.1 R; 24/715.6; D6/581; 16/422, 426, 427, 428
See application file for complete search history.

(56) References Cited

U.S. PATENT DOCUMENTS 2,107,459 A 2/1938 Weller
2,107,948 A 2/1938 King
2,112,100 A 3/1938 King
2,532,202 A 11/1950 Steinbachner
2,762,056 A 9/1956 Glagovsky
4,112,551 A * 9/1978 Sales ..... 24/712.5
4,759,398 A * 7/1988 Renee ..... 160/178.1 R
4,782,560 A 11/1988 Keller
5,634,244 A * 6/1997 Fetsch et al. ..... 24/115 F
5,735,329 A 4/1998 Akins et al.
5,919,542 A * 7/1999 Chou ..... 428/99
6,066,371 A 5/2000 Zehetner
6,089,303 A * 7/2000 Metcalf et al. ..... 160/176.1 R
6,135,188 A * 10/2000 Anderson et al. ..... 160/178.1 V
2002/0195211 A1 12/2002 Osinga

FOREIGN PATENT DOCUMENTS

CA 2236889 11/1999
NZ 328531 10/1999

* cited by examiner

*Primary Examiner*—Blair M. Johnson
(74) *Attorney, Agent, or Firm*—Dorsey & Whitney LLP

(57) ABSTRACT

A tassel for use in a covering for an architectural opening is provided with an opening in one end for receiving a flexible elongated member of the type used in operating such coverings and an opening of a different configuration in the opposite end for receiving a wand or similar rigid elongated member also used in operating coverings for architectural openings. An outer cover is also provided for covering at least a portion of the tassel body.

11 Claims, 9 Drawing Sheets

TASSEL FOR A COVERING FOR AN ARCHITECTURAL OPENING

CROSS REFERENCE TO RELATED APPLICATION

This application claims priority to European patent application No. 03077740.3, filed Sep. 1, 2003, which is hereby incorporated by reference as if fully disclosed herein.

BACKGROUND OF THE INVENTION

1. Field of the Invention

This invention relates to a multi-purpose tassel for the operating elements of a retractable covering for an architectural opening, such as a window covering.

2. Description of the Relevant Art

A window covering, such as a venetian blind with horizontal or vertical slats, is typically provided with a first operating element for lifting or traversing the slats and a second operating element for tilting the slats. Generally, such operating elements will include a cord or ball chain for traversing the slats and a wand for tilting them. Curtains, however, can have either cords or wands for traversing.

It is generally desirable for the look of a window covering, particularly in an office or dwelling with many window coverings, that the tassels of the operating elements of each window covering are uniform in appearance. Tassels of uniform appearance can also provide a distinctive "look" to the window coverings of their manufacturer. For this reason, tassels of window coverings have often been provided with the logo, mark or name of the manufacturer of the window coverings. Thus, tassels of uniform appearance have been sought for attachment to window covering cords and wands.

However even though tassels for cords and wands may look the same, they are technically different parts. Attaching a tassel to a pull cord has typically required a different tassel shape than for attaching a tassel to a tilt wand. This has resulted in the production of tassels that appear the same but are technically different. As a result, there has inevitably been confusion during the assembly of window coverings with such tassels, as well as more expense than if the tassels for both cords and wands had, in fact, been identical.

SUMMARY OF THE INVENTION

In accordance with this invention, a tassel is provided which can be connected in an upright position to a cord or similar flexible elongated member and in an inverted position to a wand or similar rigid elongated member while maintaining a uniform outer appearance for the tassel.

According to one aspect of the invention, a two-part tassel is provided, which comprises: a) a hollow body with:

an upright side wall containing a coaxial interior space, a top wall, and a bottom wall and wherein a first aperture is formed through the top wall, through which the cord can be inserted into the interior space to connect the cord to the tassel, wherein a second aperture is formed through the bottom wall, through which the wand can be inserted into the interior space to connect the wand to the tassel and wherein the body has its top wall on top in the upright position and its bottom wall on top in the inverted position; and b) a cover connectable to the exterior of the body.

BRIEF DESCRIPTION OF THE DRAWINGS

Further aspects of the invention will be apparent from the detailed description below of specific embodiments and the drawings thereof, in which.

DETAILED DESCRIPTION OF THE PREFERRED EMBODIMENTS

Figure 1:
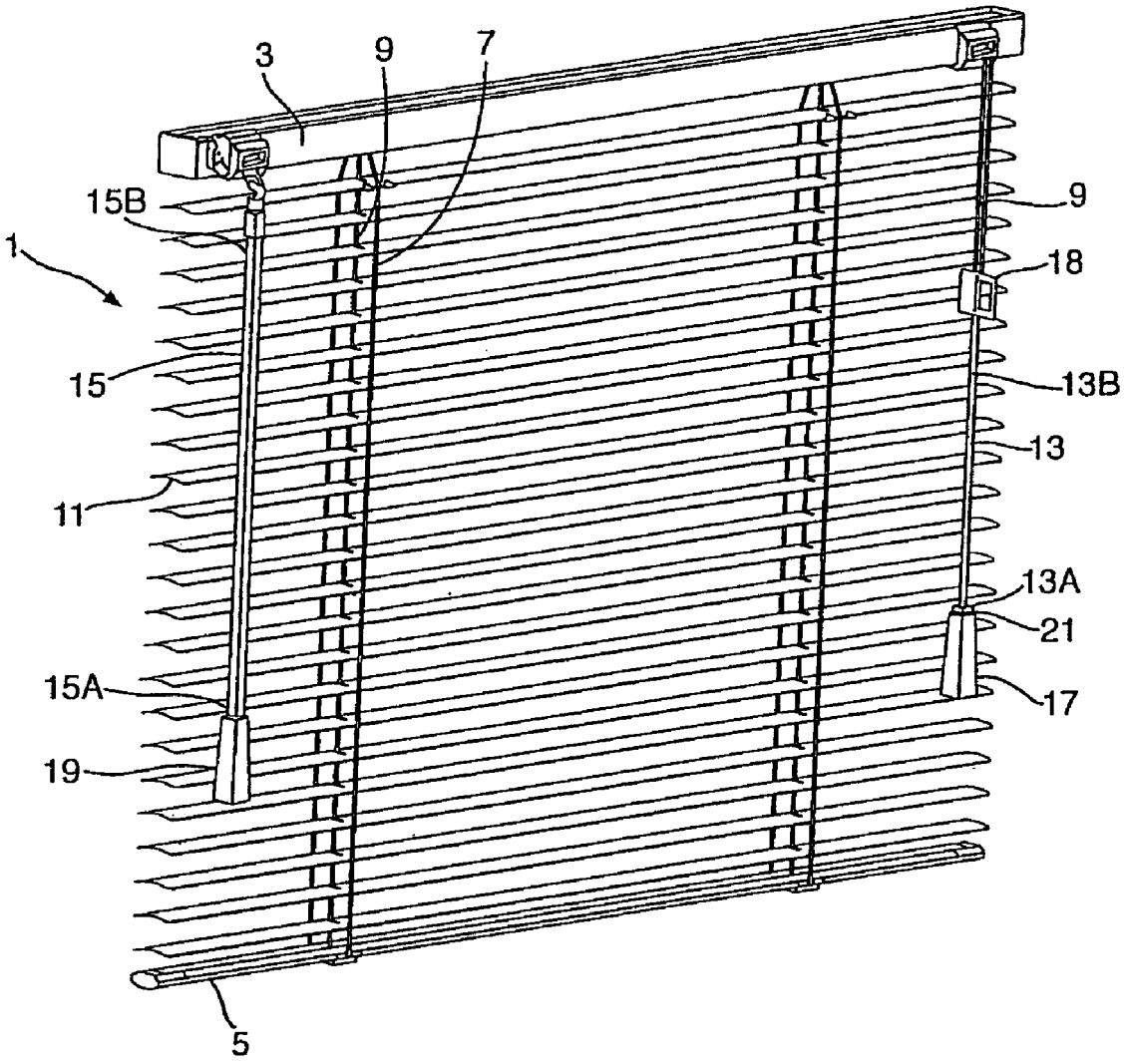
Fig.1. (Prior Art)
FIG. 1 is a front view of a typical venetian blind with a first prior art embodiment of a tassels on a cord and wand.

FIG. 1 shows a conventional venetian blind 1, which includes a head rail 3, a bottom rail 5, ladders 7, lift cords 9 and slats 11. The blind also includes an operating cord 13 and a tilt wand 15. Both the downwardly-extending operating cord 13 and tilt wand 15 have a prior art tassel 17, 19 attached to their free lower end portions 13A, 15A. The upper end portions 13B of the cord are attached to a conventional cord equalizer 18 which is, in turn, connected to a conventional mechanism in the head rail 3 for raising and lowering the slats 11 when the cord is pulled in one direction or the other. The upper end portions 15B of the wand are attached to a conventional mechanism in the head rail 3 for tilting the slats 11 when the wand is twisted. Although these prior art cord and wand tassels 17, 19 have a uniform appearance, they are not the same.

Cord tassel 17 has an aperture for accommodating the operating cord's lower end portions 13A. The lower end portions 13A of the operating cord 13 can be attached directly to the tassel 17 or, as shown, to an intermediate attaching part 21. The cord tassel 17 cannot be attached suitably to the wand 15.

Likewise, the wand tassel 19 has an aperture for accommodating the lower end portions 15A of the wand 15. The wand 15 has a typical hexagonal cross-section, and the wand aperture has a similar cross-section of a slightly smaller dimension. The wand's lower end portions 15A can be friction fit into the aperture of the wand tassel 19, and an adhesive can be used to assure a durable connection between the wand's lower end portions 15A and the wand tassel 19. The wand tassel 19 cannot be suitably attached to the operating cord 13.

In accordance with this invention, multi-purpose tassels 120, 220, as shown in FIGS. 2-6, are provided which can be connected to both a wand 115, 215 and a cord 113, 213 of a venetian blind as shown in FIG. 1 but which will have the same appearance in both cases.

Figure 2A:
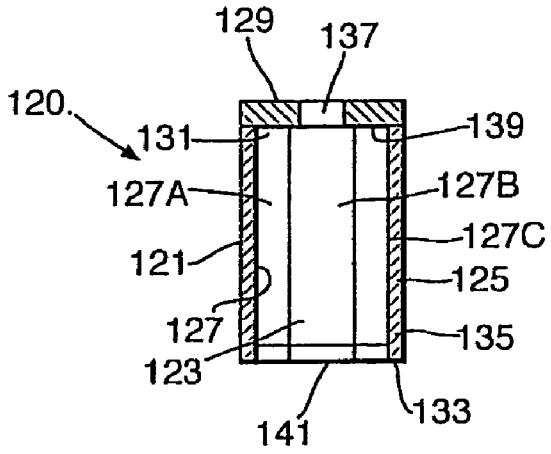
Fig.2A. (Prior Art)
FIG. 2A is a cross-sectional view of a second prior art embodiment of a tassel in an upright position.
Figure 2B:
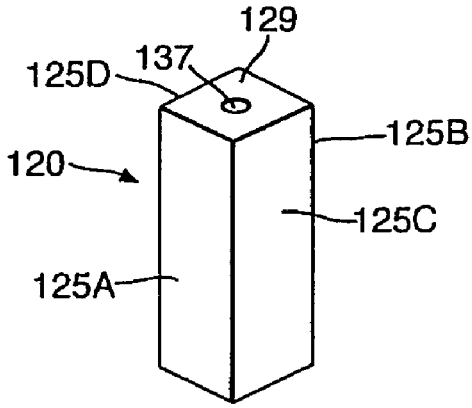
Fig.2B. (Prior Art)
FIGS. 2B and 2C are perspective views of the second prior art tassel of FIG. 2A in upright and inverted positions, respectively.
Figure 2C:
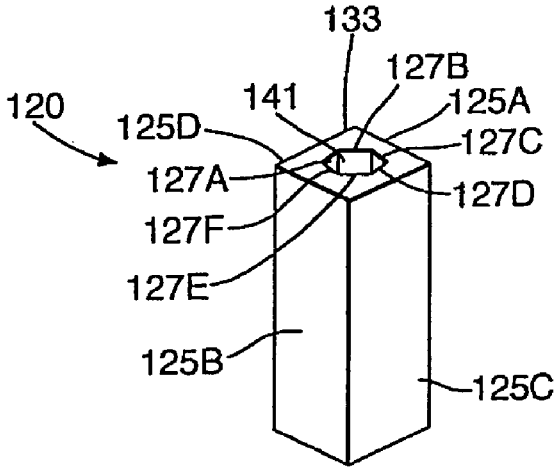
Fig.2C. (Prior Art)
Figure 3B:
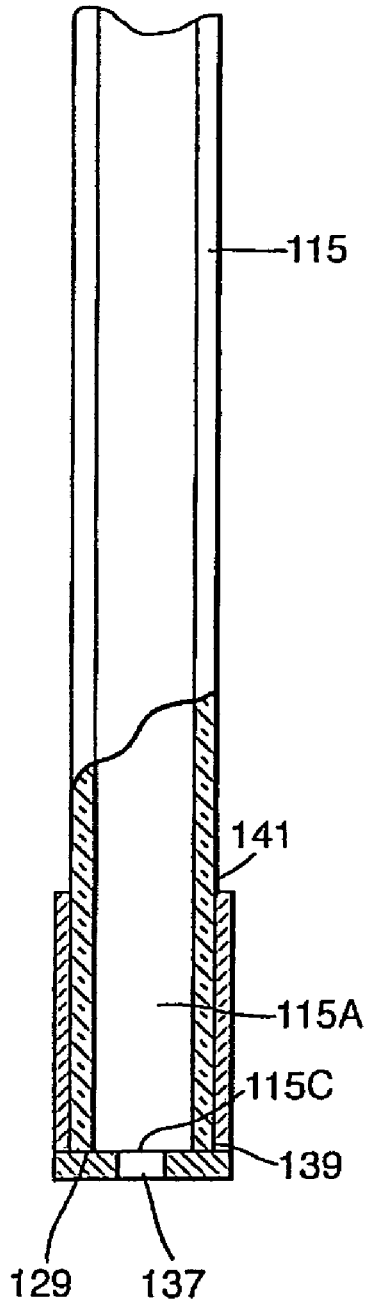
Fig.3B. (Prior Art)
FIG. 3B is a cross-sectional view of the second prior art tassel of FIG. 2A, inverted and assembled to a wand.
Figure 3A:
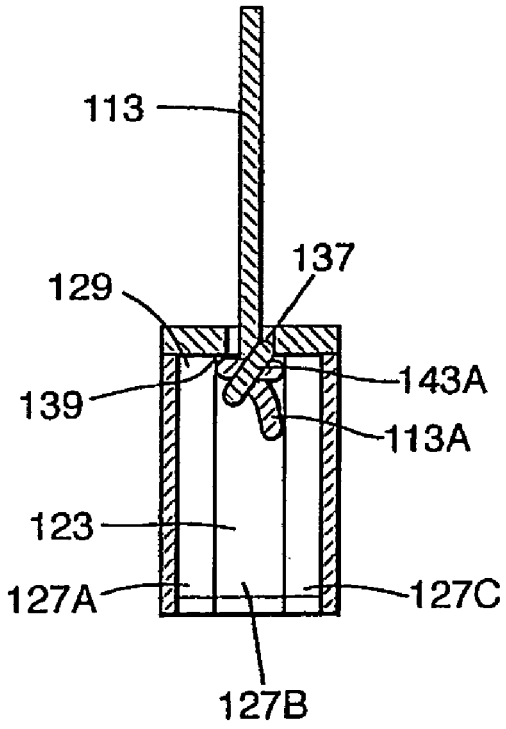
Fig.3A. (Prior Art)
FIG. 3A is a cross-sectional view of the second prior art tassel of FIG. 2A, upright and assembled to a cord.

FIGS. 2-3 show a prior art embodiment 120 of a multi-purpose tassel, having a hollow vertically-extending body 121 with an interior space 123 that extends coaxially. In FIGS. 2A, 2B and 3A, the prior art tassel 120 is upright and in FIGS. 2C and 3B, the tassel 120 is inverted. The tassel body 121 has vertically-extending, circumferential, outer and inner side walls 125, 127, horizontally-extending, outer and inner, top walls 129, 131 and horizontally-extending, outer and inner, bottom walls 133, 135. The outer side wall 125 defines the outer shape of the body 121. In FIGS. 2B and 2C, the outer side wall 125 is shown with a generally rectangular, preferably square, horizontal cross-section and comprises left, right, front and rear, rectangular side walls 125A, 125B, 125C, 125D. However, the outer side wall 125 of the body 121 can have other shapes, such as circular or elliptical in horizontal cross-section. The shape of the interior space 123 of the body 121 is defined by the circumferential inner side wall 127, together with the inner top wall 131 and inner bottom wall 135. This interior space 123 has a size and functional shape that allow the tassel body 121 to be attached to the lower end portions 113A, 115A of either a cord 113 or a wand 115. In FIG. 2C, the inner side wall 127 is shown with a generally hexagonal, horizontal cross-section with side walls 127A-127F that can cooperate with the hexagonal sides of the lower end portions 115A of a wand 115.

FIG. 2B shows a vertically-extending cord aperture 137 that is provided through the outer and inner, top walls 129, 131 of the tassel body 121 into its interior space 123. The cord aperture 137, which is preferably round, is used when the prior art tassel 120 is attached to lower end portions 113A of a cord 113. Surrounding the cord aperture 137 and part of the inner top wall 129 is an abutment surface 139, against which either a cord stopping element 143 will abut to hold the cord 113 on the tassel or the bottom end of a wand 115 will abut when inserted in the tassel.

FIG. 2C shows a vertically-extending wand aperture 141 that is provided through the outer and inner, bottom walls 133, 135 of the tassel body 121 into its interior space 123. The wand aperture 141 logically has the same horizontal cross-section (e.g., hexagonal) as the lower end portions 115A of a wand 115, to be inserted into the tassel.

FIGS. 3A and 3B show the prior art tassel 120 with a cord 113 or wand 115 assembled to it.

With the cord 113, the prior art tassel 120 is used with its cord aperture 137 upwardly as shown in FIG. 3A. The free lower end portions 113A of the cord 113 can be threaded through the cord aperture 137 from top down or bottom up, depending on the type of stopping element 143, to be used. If a simple knot 143 is used as the stopping element, the free lower end portions 113A of the cord 113 can be threaded top down through the cord aperture 137, the knot 143 can be made, and then, the tassel 120 can be slid down along the cord until the knot firmly abuts against the abutment surface 139. In this way, it is also possible to clamp or crimp a stopping element to the lower end portions 113A of the cord 113 after threading it through the cord aperture 137. Clearly, if a stopping element 143 is already fixed to the free lower end portions 113A of the cord 113 or if a knot 143 is already made there, threading the lower end portions of the cord through the cord aperture 137 from the bottom up is the only alternative.

FIG. 3A shows the cord 113 extending in a vertical or upright direction away from the tassel through the cord aperture 137. A knot 143 is shown at the free lower end portions 113A of the cord, abutting against the abutment surface 139 of the inner top wall 129 of the tassel body 120. The upper end 113B of the operating cord 113 can be attached to a cord equalizer, which is in turn connected to a mechanism of the blind for raising and lowering its slats as described above with regard to FIG. 1.

With the wand 115, the prior art tassel 120 is used with its cord aperture 137 downwardly as shown in FIG. 3B and its body 121 turned upside down relative to its position shown in FIG. 3A. As shown in FIG. 3B, the free lower end portions 115A of the wand 115 can be simply stuck into the interior space 123 of the tassel body 121 through the wand aperture 141, so that the wand's lower end portions 115A extend into the interior space 123 of the tassel. A generally horizontally-extending bottom end surface 115C of the wand's lower end portions 115A is shown in abutment with the abutment surface 139 of the inner top wall 129 of the tassel body 121. Since the side walls 127A-127F of the interior side wall 127 of the tassel body 121 provide an interior space 123 which substantially matches the shape and size of the lower end portions 115A of the wand 115, the lower end portions 115A have a friction fit within the tassel body. Of course, an even tighter fit can be obtained by providing an adhesive within the interior space 123 of the tassel 120.

The upper end portions (not shown) of the wand 115 can be connected to a mechanism of the blind for tilting its slats as described above with regard to FIG. 1.

The cord aperture 137 can have any horizontal cross-sectional shape and dimensions suitable for threading the free, lower end portions 113A of the cord 113, so long as the cord stopping element or knot 143 cannot pass through the cord aperture. In this regard, it generally suffices to have the shape and dimensions of the cord stopping element 143 larger than those of the cord aperture 137. In addition, the cord aperture 137 must have a horizontal cross-sectional shape and dimensions smaller than those of the lower end portions 115A of the wand 115, so that the inner top wall 131 has an abutment surface 139 for the bottom end 115C of the wand.

Likewise, the wand aperture 141 can have any horizontal cross-sectional shape and dimensions suitable to accommodate the cross-section of the wand 115. If the wand is round so can be the second aperture. Thus, the wand 115 and wand aperture 141 can both be circular, square, hexagonal, rectangular, oval, diamond-shape, etc. in horizontal cross-section.

As seen from FIGS. 3A and 3B, the prior art tassel 120 has the same appearance when upright and attached to cord 113 as when inverted and attached to a wand 115. The visible outer side wall 127 can be of any desired shape but should be symmetrical with regard to the vertical center of the body 121, between its outer top and bottom walls 131, 135, so that no matter whether the tassel is upright or inverted, its appearance is the same. Lettering, symbols or other markings on the outer side wall 127 can be used, but will appear different depending upon whether the tassel is upright or inverted.

Figure 4:
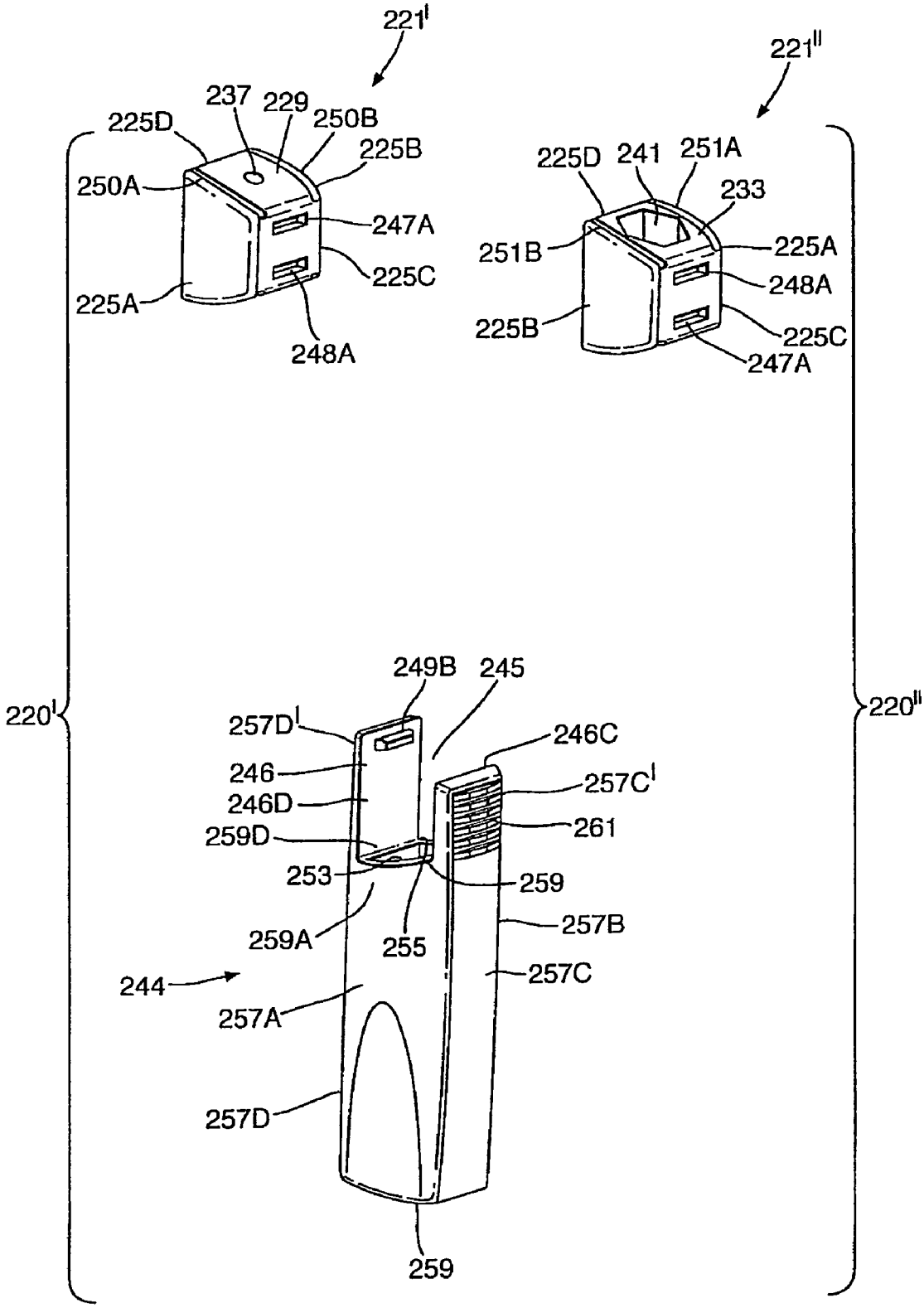
FIG. 4 is a perspective view of an embodiment of the tassel of this invention.
Figure 5:
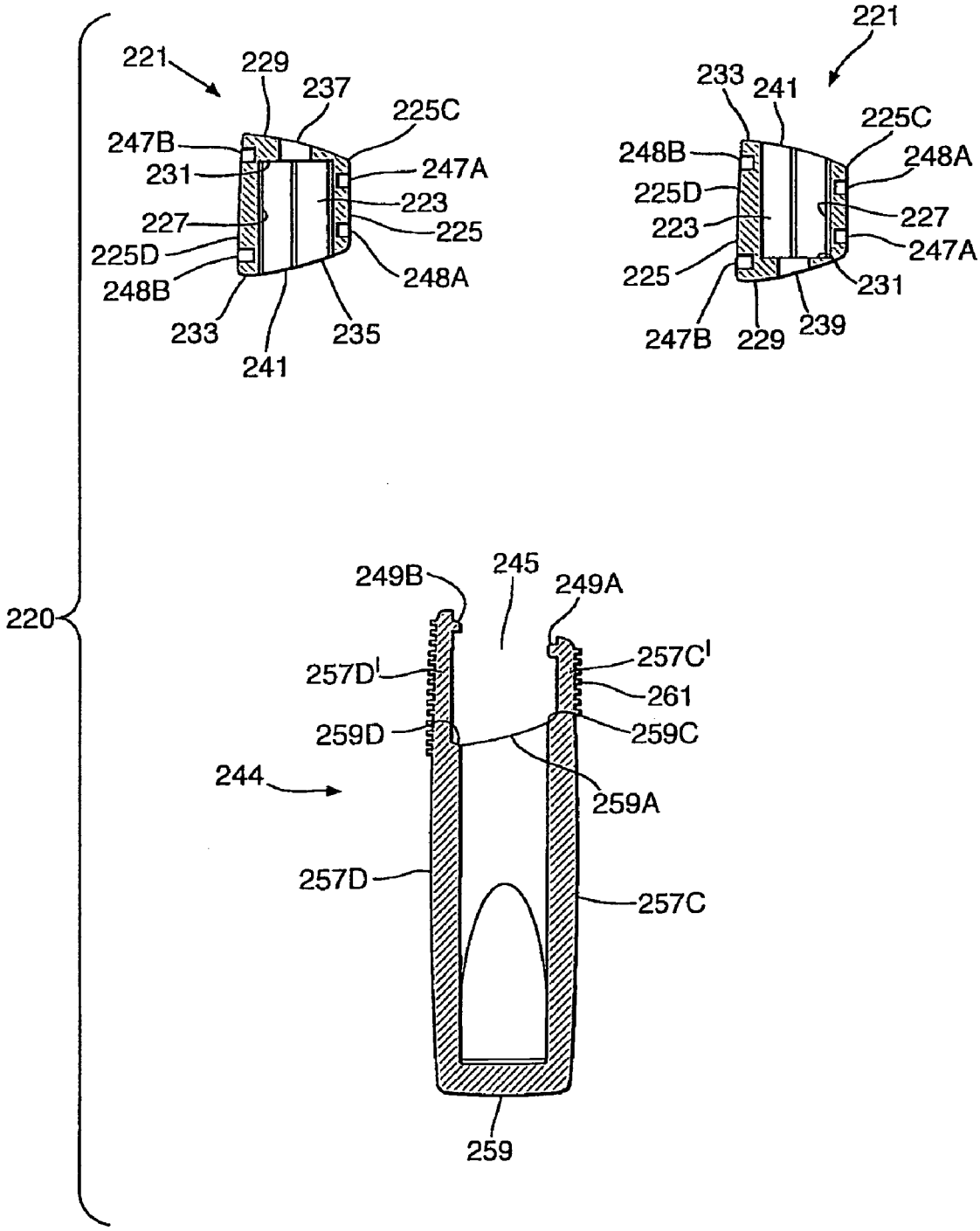
FIG. 5 is a cross-sectional view of the tassel of the invention of FIG. 4.
Figure 6A:
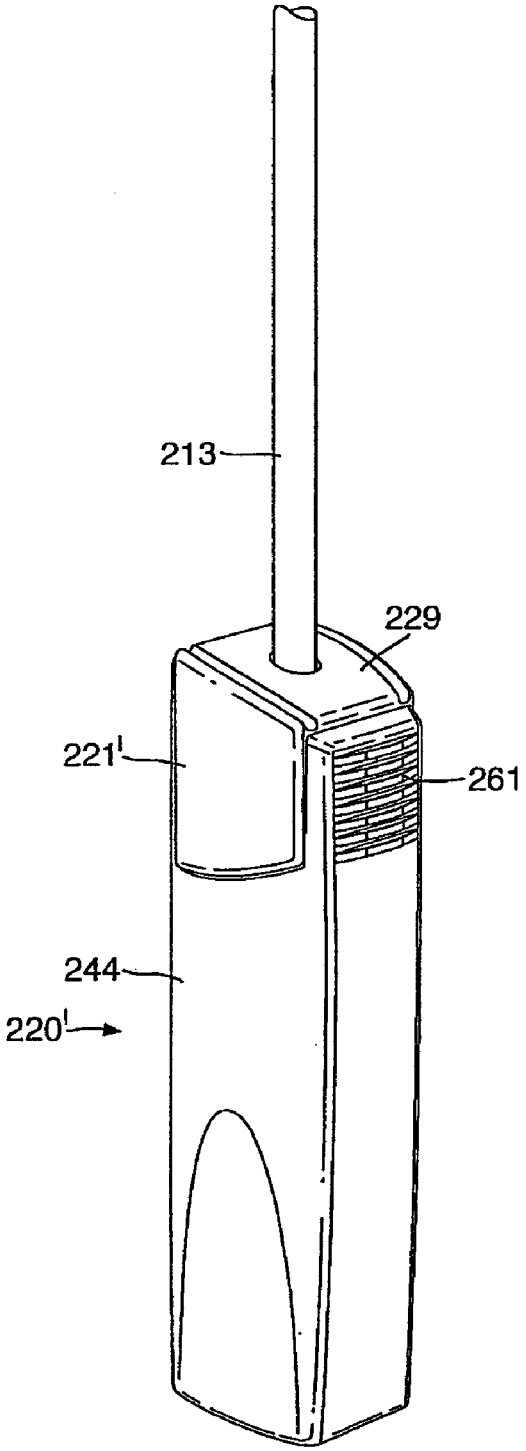
FIG. 6A is a perspective view of the tassel of FIG. 4, assembled to a cord.
Figure 6B:
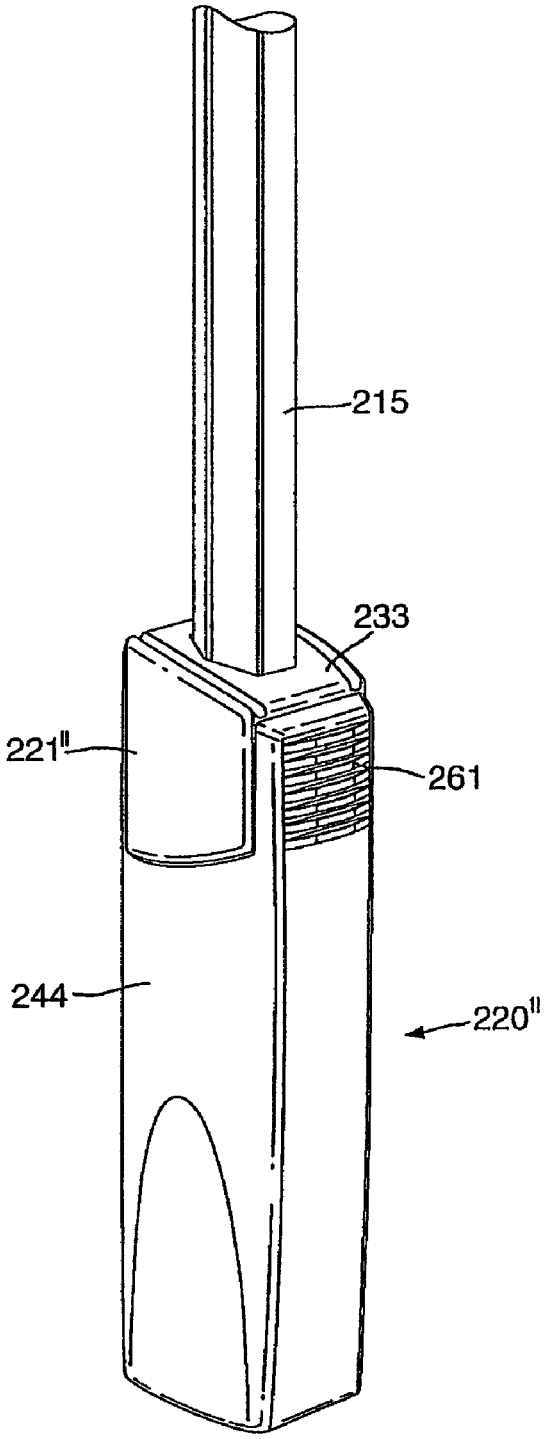
FIG. 6B is a perspective view of the tassel of FIG. 4, assembled to a wand.
Figure 6C:
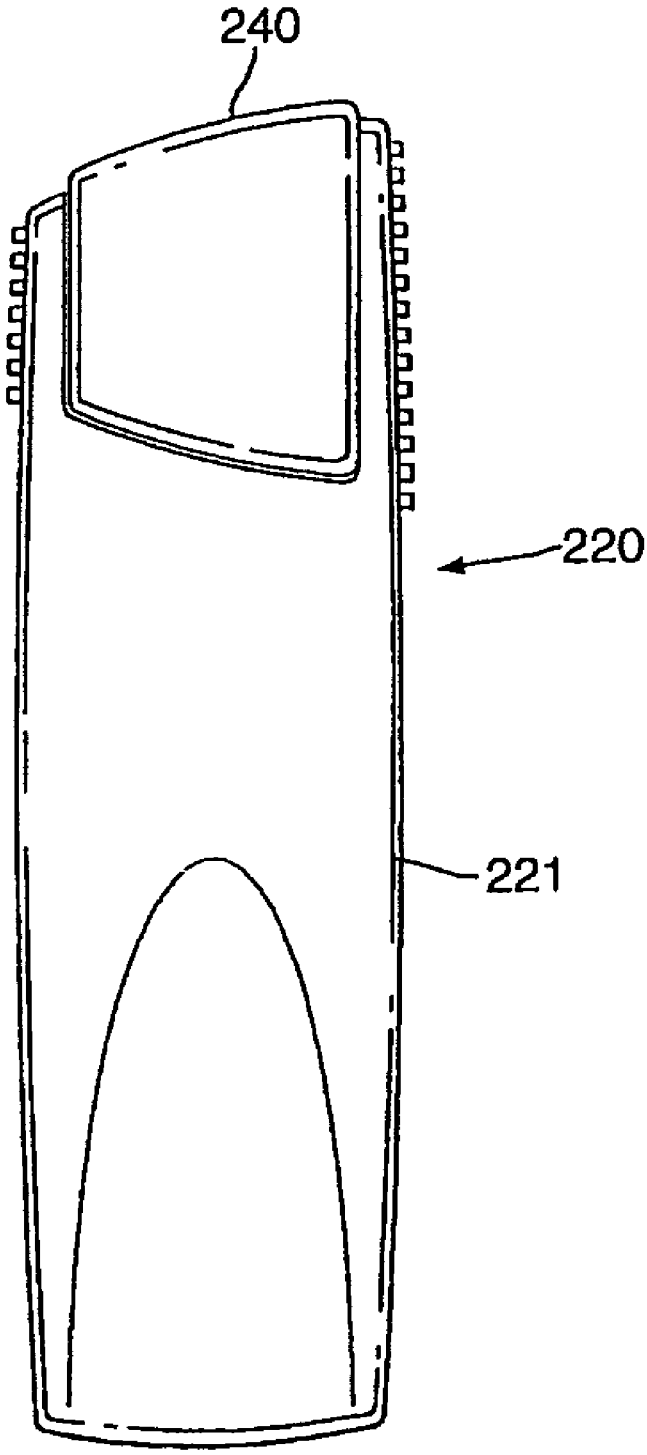
FIG. 6C is a plan view of the left side of just the tassel of FIG. 4.
Figure 6D:
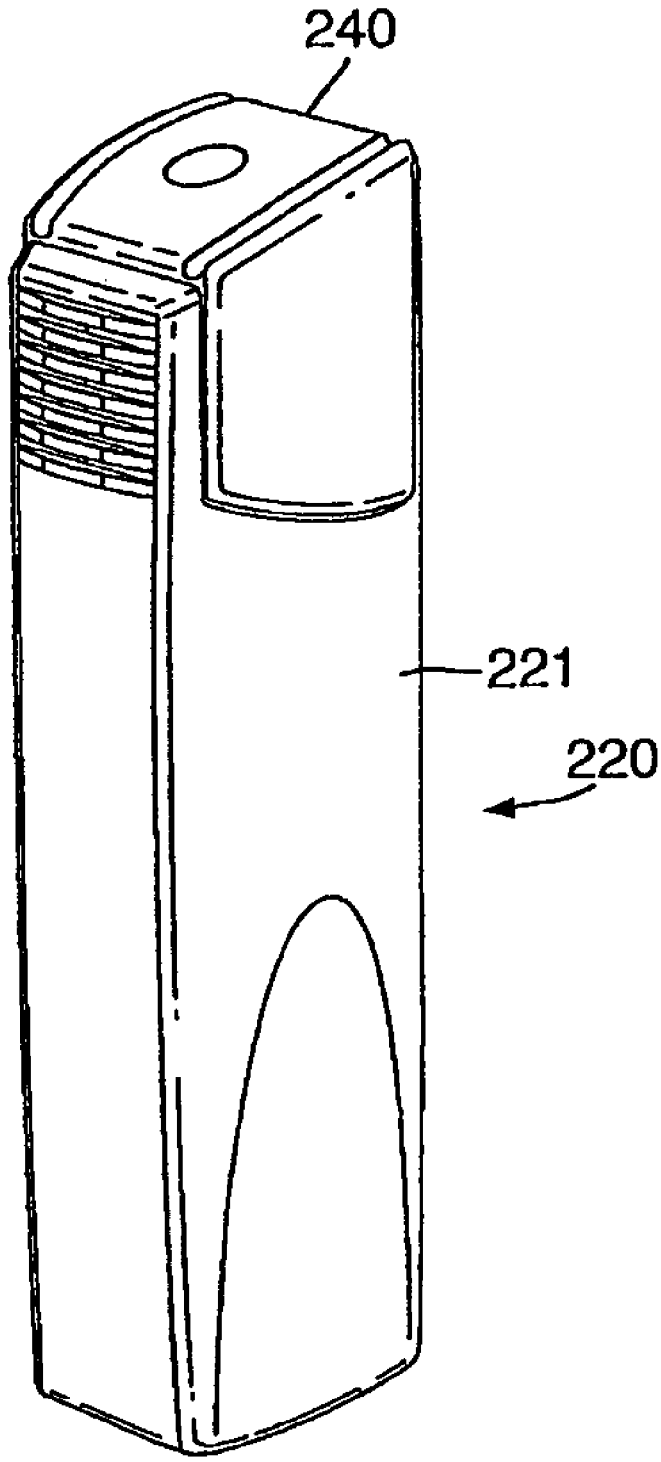
FIG. 6D is a perspective view of the front of just the tassel of FIG. 4.
Figure 6E:
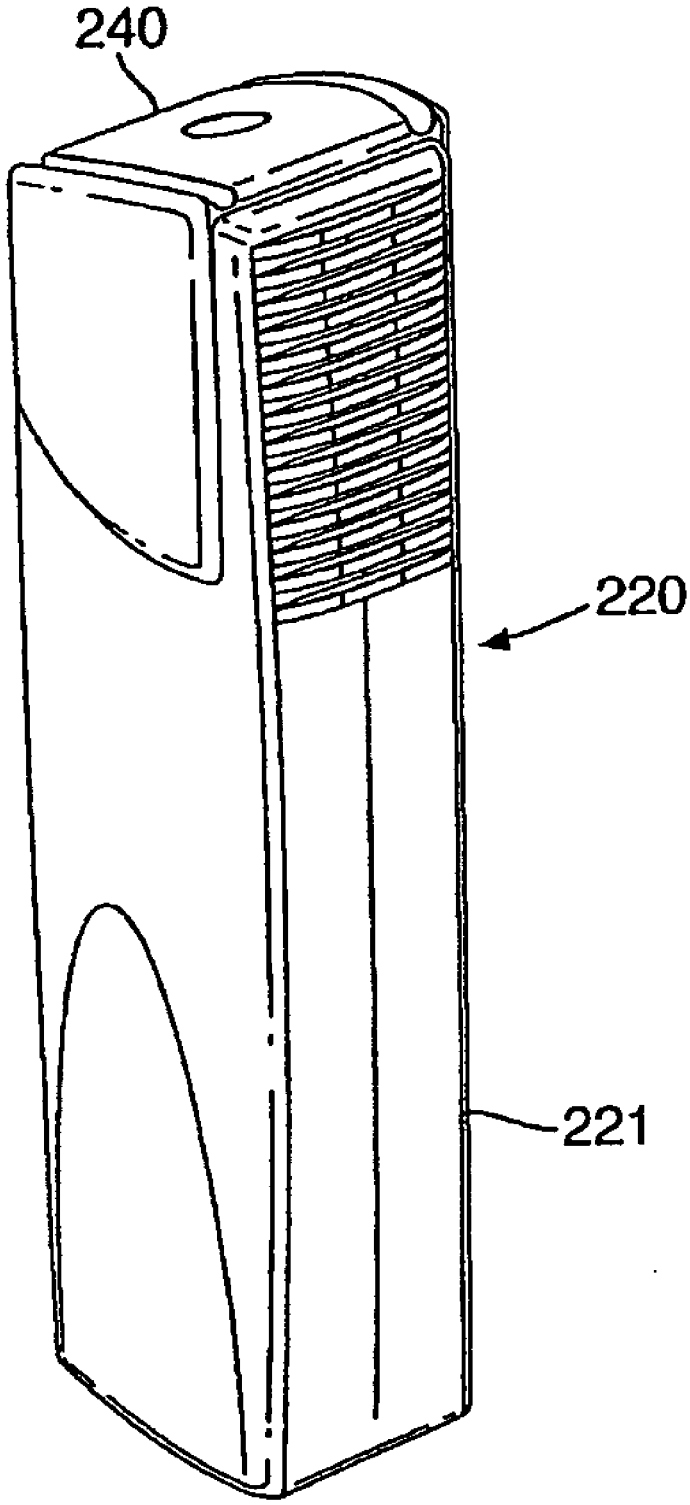
FIG. 6E is a perspective view of the rear of just the tassel of FIG. 4.

FIGS. 4-6 show an embodiment 220 of a multi-purpose tassel of this invention, which is similar to prior art the tassel 120 of FIGS. 2-3 and for which corresponding reference numerals (greater by 100) are used below for describing the same parts or corresponding parts.

The tassel 220 of the invention has a hollow vertically-extending body 221, with an interior space 223 that extends coaxially. A cover 244 can be connected to the tassel body 221 by partially or completely inserting the body through an open top of the cover into its upper portion 245 which forms a recess on top of the cover. In FIGS. 4-6, a snap-fit arrangement between opposite sides of the inner side wall 246 of the upper portion 245 of the cover 244 and opposite sides of the outer side wall 225 of the tassel body 221 is shown, but the two parts could also be held together by a friction fit, with adhesive or by ultrasonic welding. The inner side wall 246 of the upper portion 245 of the cover 244 has a horizontal cross-section with a complementary shape and size to that of the outer side wall 225 of the tassel body 221, to be inserted therein.

The circumferential outer side wall 225 of the tassel body 221 preferably comprises left, right, front and rear, side walls 225A, 225B, 225C, and 225D. Preferably, the front and rear, outer side walls 225C, 225D are rectangular, the front outer side wall 225C is shorter than the rear outer side wall 225D, and the left and right, outer side walls 225A, 225B are of a trapezoidal shape, with top and bottom sides that converge towards the front side wall 225C. The lower sides of the left and right, outer side walls 225A, 225B preferably are slightly concave upward, and the upper sides of the left and right, outer side walls preferably are slightly concave downward.

In FIGS. 4 and 5, side-by-side, upright and inverted, tassel bodies 221', 221" are shown which are otherwise the same. Tassel body 221' assembled to cover 244, results in tassel 220'. Similar, tassel body 221" with cover 244 makes tassel 220". Atop the upright tassel body 221' are a vertically-extending cord aperture 237 that extends through the body's outer and inner, top walls 229, 231 and into its interior space 223 and an abutment surface 239 on a non-apertured part of body's inner top wall 231. Under the upright tassel body 221' is a vertically-extending wand aperture 239 that extends through the body's outer and inner, bottom walls 233, 235 and into its interior space 223. The upright tassel body 221' can be connected to a cord (not shown), inserted through the cord aperture 237, and then, the upright tassel body can be inserted into the upper portion 245 of the cover 244.

Atop the inverted tassel body 221" is the wand aperture 241 in the body's outer and inner, bottom walls 233, 235, and on the bottom of the inverted tassel body 221" are the cord aperture 237 in the body's outer and inner, top walls 229, 231 and the abutment surface 239. The inverted tassel boy 221" can be connected to a wand (not shown), inserted through the wand aperture 239, and then, the inverted tassel body can be inserted into the upper portion 245 of the cover 244.

Since the tassel body 221 is symmetrical in shape with regard to its vertical center, between its outer top and bottom walls 231, 235, turning it over will not affect the complementarity of the outer side wall 225 of the tassel body relative to the inner side wall 246 of the upper portion 245 of the cover 244. Because the cover 244 will not be inverted, in use, its outer wall does not have to be symmetrical in shape with regard to its vertical center and indeed can have any shape and be provided with lettering, marking or symbols.

The tassel body 221 can be snap fit into the upper portion 245 of the cover 244 in any conventional manner. For this purpose, the front and rear, outer side walls 225C, 225D preferably each have a pair of parallel, horizontally-extending, upper slots 247A, 247B and a pair of parallel, horizontally-extending, lower slots 248A, 248B. These slots 247A, 247B, 248A, 248B are adapted to engage a pair of parallel, horizontally-extending snap-lugs 249A, 249B on the front and rear, inner side walls 246C, 246D of the upper portion 245 of the cover 244 to snap-fit the tassel body into the cover's upper portion 245.

The tassel body 221 is also provided with parallel, left and right grooves 250A, 250B in its outer top wall 229, and corresponding left and right grooves 251A, 251B in its outer bottom wall 235. These grooves are complementary in shape and dimension to left and right, upwardly-extending, shoulder ridges 253, 255, described below, that are atop the bottom of the upper portion 245 of the cover 244. The grooves 250A, 250B and 251A, 251B and shoulder ridges 253, 255 cooperate with each other to provide a close fit of the cover to the tassel body.

The cover 244, as shown in FIGS. 4-6, is generally rectangular in horizontal and vertical cross-section. The cover has a circumferential outer side wall 257, formed by left, right, front and rear, side walls 257A, 257B, 257C, 257D which extend vertically and are connected, at generally right angles, to each other and to a horizontally-extending bottom wall 259. The recess in the upper portion 245 of the cover 244 is formed by upper portions 257C', 257D' of the front and rear, side walls 257C, 257D which extend above the left and right, side walls 257A, 257B. Once the tassel 220 is assembled, the left and right side walls 225A, 225B of the body 121 will remain visible within the cover 244.

The upper portions 257C', 257D' of the front and rear, side walls 257C, 257D of the cover 244 act as cantilever beams for the snap-fit of the tassel body 221 with the cover.

The thickness of the upper portions 257C', 257D' of the front and rear, side walls preferably is tapered (i.e., less) towards their top, so that they can flex somewhat outwardly when the tassel body 221 is inserted downwardly in the open top of the cover 244, causing the snap-lugs 249A, 249B on each of the front and rear, inner side walls 246C, 246D of the cover's upper portion 245 to be urged outwardly by the front and rear, outer side walls 225C, 225D of the body and then flex back inwardly as the snap-lugs 249A, 249B enter horizontally into the upper slots 247A, 247B (if the body is upright) or lower slots 248A, 248B (if the body is inverted) in the body's front and rear, outer side walls.

Preferably, the snap-lugs 249A, 249B are generally conventional, protruding lugs on the front and rear, inner side walls 246C, 246D of the cover's upper portion 245, and each snap-lug has a gentle ramp at its top or entrance side and a sharper angle at its bottom or retraction side. The location of the upper and lower slots 247A, 247B, 248A, 248B in the tassel body's front and rear, outer side walls 225C, 225D is complementary to the location of the snap-lugs 249A, 249B on each of the front and rear, inner side walls 246C, 246D, so that the snap-lugs will engage the slots once the tassel body 221, whether upright or inverted (depending on whether a cord or a wand is to be attached to the tassel 220), is inserted into the recess formed by the cover's upper portion 245.

For further support of the tassel body 221, whether upright or inverted, in the cover's upper portion 245, a circumferential shoulder 259 extends inwardly along the left, right, front and rear, inner side walls 246A, 246B, 246C, 246D at the bottom of the upper portion 245 of the cover 244. The circumferential shoulder 259 thus defines the bottom of the recess formed by the cover's upper portion 245 at a distance beneath the top of the cover substantially equal to the height of the body's front and rear, outer side walls 225C, 225D. The circumferential shoulder 259 has left and right shoulder portions 259A, 259B which are located at the top of the left and right, inner side walls 246A, 246B, and atop these shoulders portions are the left and right, upwardly-extending shoulder ridges 253, 255, respectively, described above. The circumferential shoulder 259 also has front and rear, shoulder portions 259C and 259D which are located on the front and rear, inner side walls 246C, 246D. Preferably, each shoulder portion 259A-D extends along the total horizontal width of its respective inner side wall 246A-D. The left and right, shoulder ridges 253, 255 are adapted to cooperate with the left and right grooves 250A, 250B and 251A, 251B of the outer, top and bottom walls 229, 235 of the tassel body 221 as described above.

When a cord 213 is to be attached to the tassel body 221 as shown in FIG. 6, the upright body is inserted into the recess formed by the upper portion 245 of the cover 244 with the body's outer top wall 229 directed upwardly and outwardly of the cover's upper portion, so that the upper slot 247A in the body's front outer side wall 225C engages the front snap-lug 249A on the cover's front, inner side wall 246C and the upper slot 247B in the body's rear outer side wall 225D engages the rear snap-lug 249B on the cover's rear, inner side wall 246D. Thereby, the grooves 251A, 251B of the body's outer, bottom wall 235 rest on the left and right, shoulder ridges 253, 255 on the left and right, inner side walls 246A, 246B at the bottom of the cover's upper portion 245 in the resulting tassel 220.

When a wand 215 is to be attached to the tassel body 221 as shown in FIG. 6, the inverted body is inserted into the recess formed by the upper portion 245 of the cover 244 with the body's outer bottom wall 233 directed upwardly and outwardly of the cover's upper portion, so that the lower slot 248A in the body's front outer side wall 225C engages the front snap-lug 249A and the lower slot 248B in body's rear outer side wall 225D engages the rear snap-lug 249B. Thereby, the grooves 250A, 250B in the body's outer top wall 229 rest on the shoulder ridges 253, 255 on the left and right, inner side walls 246A, 246B at the bottom of the cover's upper portion 245 in the resulting tassel 220.

The tassel body 221 can have any shape and size, so long as the body is symmetrical with regard to its horizontal centerline, and the upper portion 245 of the cover 244 can accommodate both the upright and inverted body.

The cover 244 of the tassel 220 can have virtually any shape or size and have lettering, symbols or other markings on its outer side wall 257. Such markings which will appear the same regardless of whether the tassel body 221 is upright or inverted because the cover will not be affected by the orientation of the body.

The tassels 120 and 220, and the tassel body 221 and cover 244 can be made of a plastic. Preferably, the cover 244 is of a clear plastic, and its outer, front and rear side walls 257C, 257D have horizontally-extending serrations 261 as shown in FIGS. 4-6.

This invention is, of course, not limited to the above-described embodiments which can be modified without departing from the scope of the invention or sacrificing all of its advantages. In this regard, the terms in the foregoing description and the following claims, such as "upright", "inverted", "top", "bottom", "horizontal", "vertical", "right", "left", "above", "below", "upper", "lower", "longitudinal" and "lateral", have been used only as relative terms to describe the relationships of the various elements of the tassel of the invention for a retractable architectural covering. For example, in a curtain or a vertical blind, the tassel of this invention can be attached to a wand that is attached directly to a curtain carrier or a lead carrier of a vertical blind.

I Claim:

1. A two-part tassel for a covering of an architectural opening, wherein the tassel can be connected in an upright position to a cord or similar flexible elongated member and in an inverted position to a wand or similar rigid elongated member while maintaining a uniform outer appearance for the tassel; the tassel comprising: a) a hollow body with: an upright side wall containing a coaxial interior space, a top wall, and a bottom wall and wherein a first aperture is formed through the top wall, through which the cord can be inserted into the interior space to connect the cord to the tassel, wherein a second aperture is formed through the bottom wall, through which the wand can be inserted into the interior space to connect the wand to the tassel, wherein said first and second apertures are of different size and/or shape, and wherein the body has its top wall on top in the upright position and its bottom wall on top in the inverted position; and b) a cover releasably connectable to the exterior of the body in two positions to selectively expose the first aperture or the second aperture.

2. The tassel of claim 1 wherein the exterior shape of the side wall of the body is symmetrical with regard to a horizontal centerline of the body, between its top wall and its bottom wall, so that its appearance is the same whether the tassel is in the upright position or the inverted position.

3. The tassel of claim 1 or 2 wherein an upper portion of the cover forms a recess of complementary shape and size to the exterior of the side wall of the body, so that the body can be wholly or partially inserted into the cover.

4. The tassel of claim 3 wherein the exterior of the side wall of the body comprises a pair of slots and the recess in the upper portion of the cover comprises a pair of snap-lugs, so that when the body is inserted wholly or partially into the recess, there is a snap-fit connection between the exterior of the side wall of the body and the cover.

5. The tassel of claim 4 wherein the slots are on opposite sides of the exterior of the side wall of the body and the snap-lugs are on opposite sides of the interior of the upper portion of the cover.

6. The tassel of claim 4 wherein the slots are parallel and preferably extend horizontally and the snap-lugs also are parallel and preferably extend horizontally.

7. The tassel of claims 1 or 2 wherein the second aperture has a horizontal cross-sectional shape coming from the group consisting of circular, rectangular, hexagonal, square or diamond shape.

8. The tassel of claim 7 wherein the horizontal cross-section of the first aperture is smaller than the horizontal cross-section of the second aperture.

9. The tassel of claim 8 wherein the interior of the top wall comprises a non-apertured abutment surface for a stopping element of the cord, if inserted in the body, and for abutting an end of the wand, if inserted in the body.

10. The tassel of claim 1 wherein the cross-sectional configuration of said second aperture is non-circular.

11. The tassel of claim 1 or 10 wherein the cross-sectional configuration of said first aperture is circular.

* * * * *